United States Patent [19]

Batzill

[11] Patent Number: 4,922,871

[45] Date of Patent: May 8, 1990

[54] ARRANGEMENT FOR THE PURIFICATION OF LUBRICATING OIL

[75] Inventor: Manfred Batzill, Neuhausen, Fed. Rep. of Germany

[73] Assignee: Dr. Ing. h.c.F. Porsche AG, Fed. Rep. of Germany

[21] Appl. No.: 390,106

[22] Filed: Aug. 8, 1989

[30] Foreign Application Priority Data

Aug. 13, 1988 [DE] Fed. Rep. of Germany ..... 3827570

[51] Int. Cl.[5] ..... F01M 1/00

[52] U.S. Cl. ..... 123/196 A; 184/6.24; 184/6.5

[58] Field of Search ..... 123/196 R, 196 A; 184/6.5, 6.24

[56] References Cited

U.S. PATENT DOCUMENTS

| | | | |
|---|---|---|---|
| 2,575,315 | 11/1951 | Edwards | 123/196 A |
| 3,295,507 | 1/1967 | Carter et al. | 123/196 A |
| 3,504,769 | 4/1970 | Mettig | 123/196 R |
| 4,151,823 | 5/1979 | Grosse et al. | 123/196 A |
| 4,538,565 | 9/1985 | Hidako et al. | 123/196 R |
| 4,656,983 | 4/1987 | Anno et al. | 123/196 R |
| 4,702,204 | 10/1987 | Anno et al. | 123/196 R |

FOREIGN PATENT DOCUMENTS 3344568 2/1986 Fed. Rep. of Germany .

*Primary Examiner*—E. Rollins Cross

*Attorney, Agent, or Firm*—Evenson, Wands, Edwards, Lenahan & McKeown

[57] ABSTRACT

An oil pump of an internal-combustion engine supplies dirty oil through a vertically extending oil feeding duct into a ring duct of an oil filter flange. From there, the oil flows through the oil filter and a central bore into a main oil duct. Since the oil feeding duct leads into the ring duct above the central bore, and the main oil duct extends above the central bore, the filter oil level, will not fall under the level of the dirty-oil inlet into the ring duct when the engine is switched off. A complete emptying of the oil filter is therefore prevented when the engine is switched off, and a fast oil pressure buildup is promoted when the engine is started again.

4 Claims, 2 Drawing Sheets

ARRANGEMENT FOR THE PURIFICATION OF LUBRICATING OIL

BACKGROUND AND SUMMARY

The invention relates to an arrangement for the purification of lubricating oil of an internal-combustion engine having an oil filter which is flanged to the outside of an engine crankcase top part above the oil level of an engine oil sump and having an oil feeding duct which is supplied by an oil pump driven by the internal-combustion engine, this oil feeding duct leading into a ring-shaped duct in the filter flange on the engine-side, and having a central bore located centrically in the filter flange, this central bore being connected to a main oil duct extending above the central bore, this main oil duct supplying the internal-combustion engine with pure oil.

An arrangement is known from German Patent (DE-PS) No. 33 44 568 in which the dirty oil is delivered by a pump driven by the internal-combustion engine and first flows through a feeding duct into a ring-shaped duct housed in the oil filter flange and from there flows into the filter housing. In this case when the engine is switched off, the pure oil space of the oil filter empties by way of a duct located below the filter in flow direction. As a result, when the engine is started again, the buildup of the required oil pressure is delayed.

An object of the invention is to prevent the complete emptying of the oil filter when the engine is switched off.

According to the invention, this object is achieved by providing an arrangement wherein the oil feeding duct leads into the ring duct extending in the filter flange in such a manner that the leading-in point is located above the central bore leading to the main oil duct.

In order to implement this type of an arrangement in a simple manner according to preferred embodiments of the invention, the oil feeding duct extends so close to the ring duct that, in the area of the oil feeding duct, it has a reduced depth. In addition the web which is enclosed by the ring duct has a slight distance from the plane extending through the flange connecting surface, and the oil feeding duct is constructed as a bore which is vertical with respect to the horizontal jointing plane of the crankcase halves.

The particular advantage which can be achieved by means of this invention is that the oil level in the filter, after the switching-off of the engine, despite a filter arrangement which is clearly above the oil level of the engine oil sump, does not fall under the uppermost level of the central bore leading to the main oil duct. The oil filter is therefore continuously more than half filled. As a result, a rapid oil pressure buildup is ensured after the starting of the engine. By the fact that the oil feeding duct extends close to the flange connecting surface, the bore enters directly into the ring duct so that no further connection is required from the oil feeding duct to the ring duct. In addition, this arrangement permits a material-saving design of the crankcase in the area of the oil filter flange which is advantageous with respect to casting, and the providing of the oil feeding duct bore in the same chucking of the crankcase half in which the crankcase joint face is worked. Finally, the slightly set-back face of the web enclosed by the ring duct reduces the surface of the flange connecting area to be worked.

Other objects, advantages and novel features of the present invention will become apparent from the following detailed description of the invention when considered in conjunction with the accompanying drawings.

DETAILED DESCRIPTION OF THE DRAWING

Figure 1:
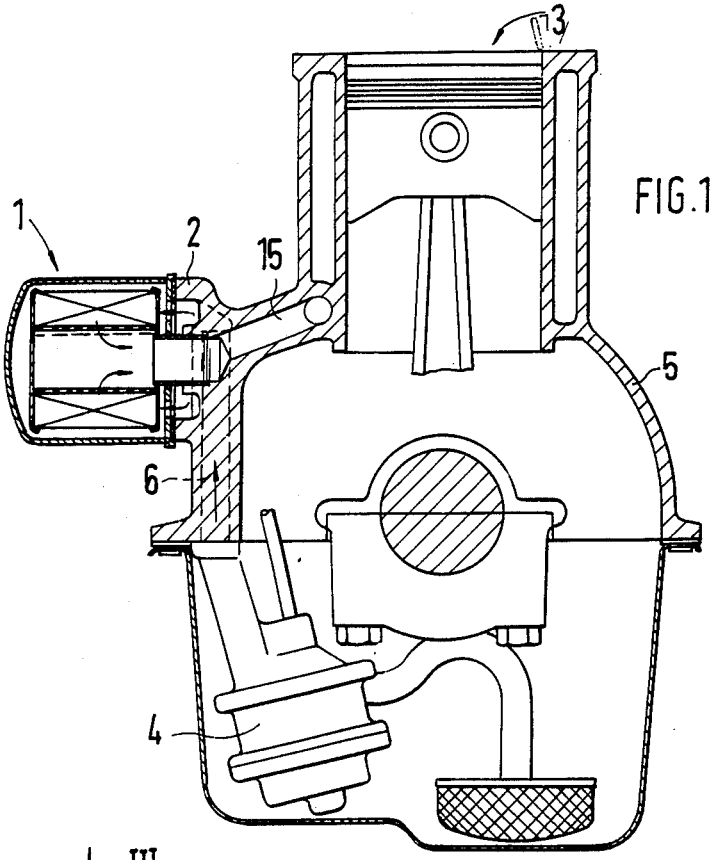
FIG. 1 is a sectional view of an internal-combustion engine having an arrangement for the purifying of lubricating oil.

An oil filter 1 is fastened to the filter flange 2 of an internal-combustion engine 3. The dirty oil delivered by an oil pump 4 flows through an oil feeding duct 6 mounted in the crankcase top half 5 of the internal-combustion engine 3 into a ring duct 7 in the filter flange 2. Through a leading-in opening 8, which is created by penetrating the ring duct 7 with the bore for the oil supply duct 6, the dirty oil flows from the oil feeding duct 6 into the ring duct 7.

Figure 2:
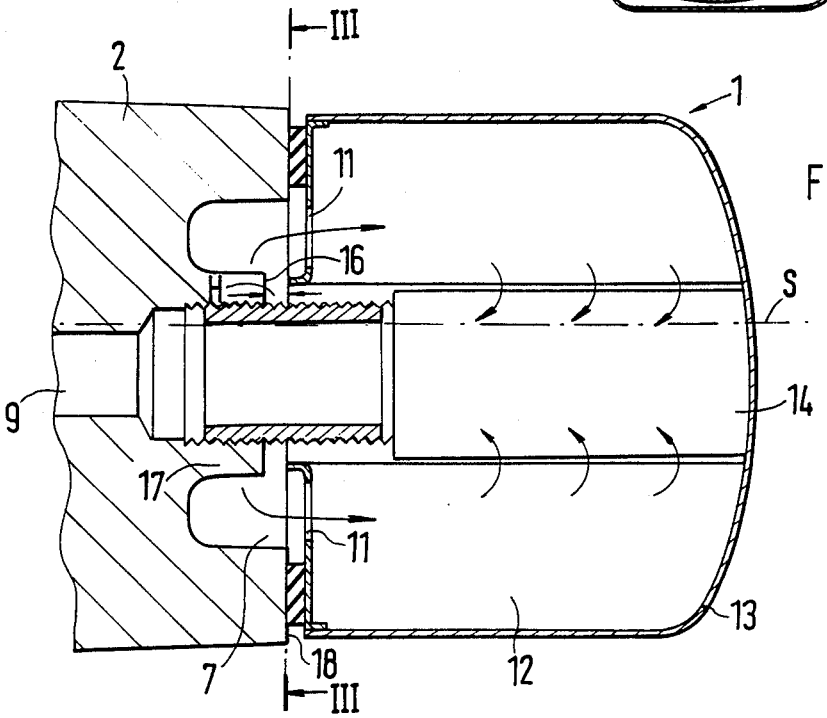
FIG. 2 is a sectional view of an oil filter mounted at the flange.
Figure 3:
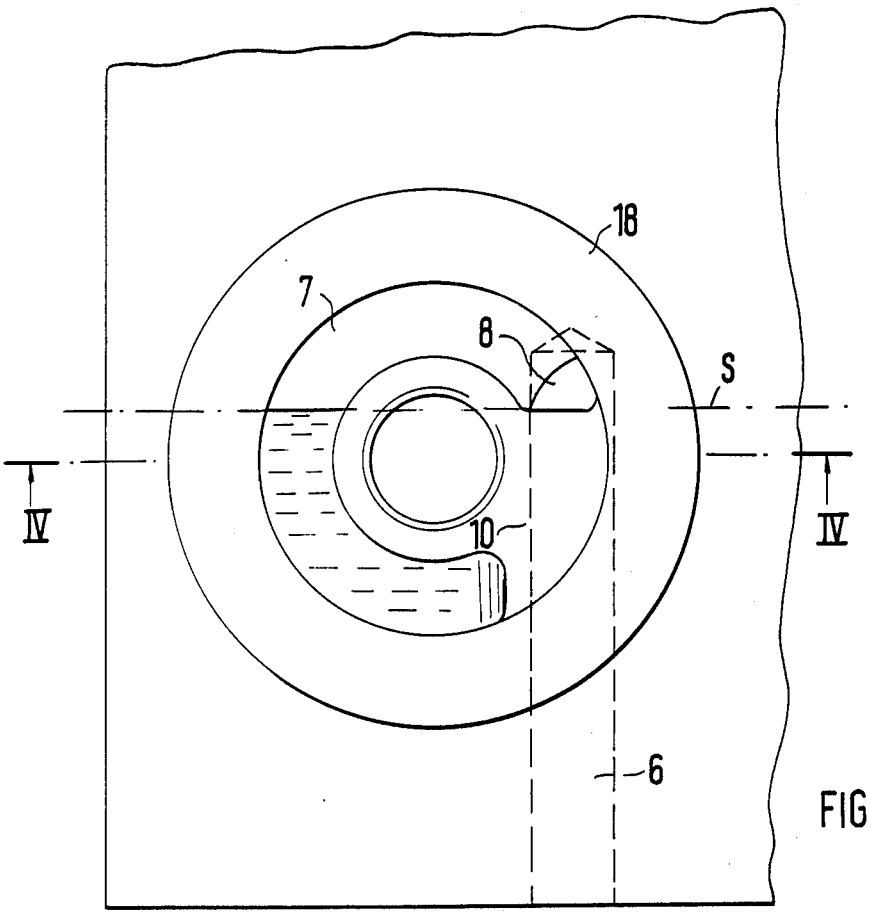
FIG. 3 is a sectional view along Line III—III of FIG. 2.
Figure 4:
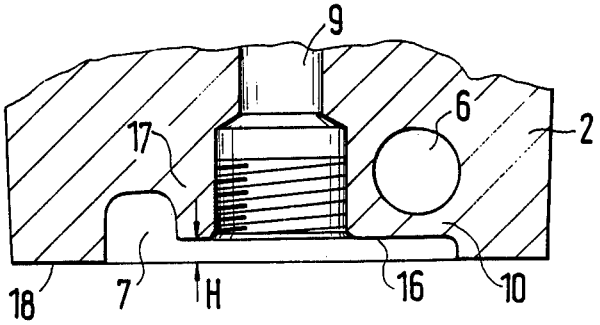
FIG. 4 is a sectional view along Line IV—IV of FIG. 3.

So that the oil feeding duct 6 does not intersect the ring duct 7 below a central bore 9, the depth of the ring duct 7 is reduced in a part 10 of the filter flange 2 close to the oil feeding duct 6. The dirty oil flows from the ring duct 7 through the inlet openings 11 into the oil filter 1. There, it first flows through a ring-shaped dirty-oil space 12, which, on the outside, is delimited by a sheet-metal housing 13 and, on the inside, by a filter cartridge 14. The dirty oil is purified in the filter cartridge 14 and subsequently, as pure oil, is discharged through the central bore 9 into a main oil duct 15. The main oil duct 15 supplies the internal-combustion engine 3 with pure oil and is disposed above the central bore 9. Since the leading-in point 8 and the main oil duct 15 are located above the central bore 9, the filter oil level (S) (FIG. 2), when the internal-combustion engine 3 is switched off, does not fall below the level of the leading-in point 8 in the ring duct 17.

In order to keep the machining expenditures low at the crankcase top part 5, its material thickness in the area of the filter flange 2 is increased to such an extent that the oil feeding duct 6 can be produced as a bore vertically with respect to the crankcase jointing face.

A face 16 of a web 17 enclosed by the ring duct 7 which faces the oil filter 1 has a slight distance H from a flange connecting surface 18 and thus reduces the size of the surface to be machined for an oiltight fitting of the oil filter 1. The distance H also permits a uniform entering of oil through all circularly arranged inlet openings 11 into the dirty-oil space 12.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An arrangement for the purification of lubricating oil of an internal-combustion engine having an oil filter which is flanged to the outside of an engine crankcase top part above the oil level of an engine oil sump and having an oil feeding duct which is supplied by an oil pump driven by the internal-combustion engine, this oil feeding duct leading into a ring-shaped duct in the filter flange on the engine-side, and having a central bore located centrically in the filter flange, this central bore being connected to a main oil duct extending above the central bore, this main oil duct supplying the internal-combustion engine with pure oil, wherein in that the oil feeding duct leads into the ring duct extending in the filter flange in such a manner that the leading-in point is located above the central bore leading to the main oil duct.

2. An arrangement according to claim 1, wherein the oil feeding duct in the crankcase top part extends from the crankcase jointing face, vertically upwards to the leading-in point.

3. An arrangement according to claim 2, wherein the ring duct, has a lower depth than on the remainder of its circumference in the area of the leading-in point, on a part of its circumference.

4. An arrangement according to claim 3, wherein the ring duct is formed by a U-shaped indentation in the filter flange, and wherein the face of a web enclosed by the ring duct is located at a distance (H) behind the flange connecting surface.

* * * * *